US005860772A

United States Patent [19]

Starita et al.

[11] Patent Number: 5,860,772

[45] Date of Patent: Jan. 19, 1999

[54] HIGH SHEAR STRENGTH CLAY LINER, METHOD AND APPARATUS FOR ITS PRODUCTION

[75] Inventors: Piero Starita; Maurizio Paoli, both of Leghorn, Italy

[73] Assignee: Laviosa Chimica Mineraria S.P.A., Leghorn, Italy

[21] Appl. No.: 632,419

[22] PCT Filed: Jul. 24, 1995

[86] PCT No.: PCT/IT95/00127

§ 371 Date: Apr. 24, 1996

§ 102(e) Date: Apr. 24, 1996

[87] PCT Pub. No.: WO96/06987

PCT Pub. Date: Mar. 7, 1996

[30] Foreign Application Priority Data

Aug. 29, 1994 [EP] European Pat. Off. ..... 94830409

[51] Int. Cl.[6] ..... E02D 3/12

[52] U.S. Cl. ..... 405/270; 405/129; 405/38

[58] Field of Search ..... 405/129, 270, 405/258, 16, 19, 34, 38, 128, 268

[56] References Cited

U.S. PATENT DOCUMENTS

| | | | |
|---|---|---|---|
| 4,534,925 | 8/1985 | Harriet | 264/281 |
| 4,565,468 | 1/1986 | Crawford | 405/270 |
| 4,815,402 | 3/1989 | Price . | |
| 5,224,434 | 7/1993 | Card et al. . | |
| 5,346,566 | 9/1994 | White | 405/270 |
| 5,401,552 | 3/1995 | Bohrer et al. | 405/270 |
| 5,403,126 | 4/1995 | Carriker et al. | 405/270 |
| 5,436,050 | 7/1995 | Carriker et al. | 405/129 X |
| 5,564,864 | 10/1996 | Simpson et al. | 405/270 |
| 5,584,609 | 12/1996 | Clarey et al. | 405/270 |

FOREIGN PATENT DOCUMENTS

| | | | |
|---|---|---|---|
| 0611850 | 8/1994 | European Pat. Off. . | |
| 41 21 712 | 1/1992 | Germany . | |
| 42 21 329 | 1/1994 | Germany | 405/270 |
| 2255785 | 11/1992 | United Kingdom . | |

*Primary Examiner*—Tamara L. Graysay
*Assistant Examiner*—Frederick L. Lagman
*Attorney, Agent, or Firm*—Browdy and Neimark

[57] ABSTRACT

A high shear strength clay liner comprising two synthetic geotextiles (1*a*, 1*b*) and a semihydrated layer (1*c*) of swellable clay therebetween with fastening means (5) arranged in such a pattern of connecting threads to form pockets (7) through the clay layer. The pattern comprises rows of independent fasteners arranged according two intersecting directions. The fasteners have knots (8) at their ends protruding from the surface of the liner. The invention also comprises a method and a machine for forming the independent fasteners by means of two parallel needle bars (104*a, b*) each carrying a row of needles (105) reciprocating in opposed directions and cooperating with a reciprocating needle plate (109) having a plurality of parallel fingers (110) and a looper bar (117) with a plurality of parallel looper plates (118) rocking on its axis to form loops (5*a*, 5*b*) which can be melted into protruding knots (8). The independent fasteners carry the major part of the shear forces on the liner avoiding failure of the fabrics and giving a much greater interfacial shear strength with a high internal friction angle.

19 Claims, 7 Drawing Sheets

HIGH SHEAR STRENGTH CLAY LINER, METHOD AND APPARATUS FOR ITS PRODUCTION

FIELD OF THE INVENTION

The present invention relates to an improved clay liner to be used to form an impermeable barrier. In particular this invention relates to an improvement in the stability of the liner while being installed and also in the hydrated state while in use in steep slopes.

The present invention also relates to a method and an apparatus for the production of the clay liner of the invention.

BACKGROUND ART

Clay liners are widely used in the fields of Civil, Environmental and Geotechnical Engineering for waterproofing surfaces of soil, lagoons, foundation surfaces, and in particular constructions for the containment of pollutant or toxic waste. The known clay liners are generally formed by a layer of swellable clay between two fabric layers (geotextiles). The clay used in this type of liner is predominantly Sodium Bentonite, wnich, when it comes into contact with water or other liquids, will swell to several times its dry volume if not restrained by a confining stress. The swelling of the clay forms an impermeable barrier. The clay is usually confined between two fabrics and the clay and fabrics are held together by either bonding with water soluble adhesive or mechanical bonding.

In adhesive bonding (see U.S. Pat. No. 4,501,788) the two fabrics and the clay are held together by a glue which permeates through the clay holding the particles together and also holding the fabrics to either side of the clay layer. With mechanical bonding the clay is in dry form either powder or granular and is held loosely in position between fabrics by needlepunching the two fibres together (see EP-A-278419). Needlepunching is a form of bonding using barbed needles which drag the fine fibre threads from one fabric to the other through the layer of clay thus holding together the two fabrics with the loose clay between. The fibres dragged across are tangled with the fibres in the main body of the textile and not fastened in any way. The process is accomplished on a machine that uses two needle boards one on the top and one on the bottom. These boards contain hundreds of barbed needles and move up and down very quickly driving the rest of needles through the liner as it passes between.

Like all clays when it is hydrated, which it must be to maintain its impermeability, it becomes very slippery and therefore unstable on a steep slope. To overcome the instability, due to a shear strength failure through the clay layer, the fabrics on either side of the clay layer must be connected to one another in some way through the clay layer.

The fine fibres mentioned in the needlepunched material also increase the shear strength of the clay liner although this is not their primary function. Needlepunched material has a number of disadvantages. The strength of the fine fibres connecting the two fabrics is low unless the intensity of the needlepunching is increased considerably, and if this is done the increased needlepunching destroys the impermeability of the liner. A further problem with the needlepunching process is that a nonwoven fabric must be used on at least one side of the liner to obtain the fine fibres for the bonding. The nonwoven material allows a lateral flow of the liquid to be contained througn the plan of this material giving a problem with leakage at the edge, or overlap, of the liner. If a woven material is used, which is preferable in this type of liner, the weave would be damaged or destroyed by the barbed needles used in the process of needlepunching and weaken the liner.

In using this type of needlepunched liner on steep slopes there is also a problem with the movement of bentonite clay within the liner. The clay in its dry form, either powder or granules, is free to move and in the process of handling during loading, unloading and installation, tends to migrate causing light areas with little or no clay and potential leakage in the depleted area. This can also happen when the clay is in a state of hydration. When the clay is hydrated without cover. material to form the confining stress, the hydrated bentonite becomes very swollen and soft, if then the cover material is placed on the liner it will displace the hydrated clay causing an increase in permeability and the liner to leak.

Another problem encountered with needlepunched clay liners is that they cannot be used in the field with a simple overlap. The seams must be sealed with a dry bentonite clay powder or a bentonite paste which is placed in position by hand. This is a very labour intensive operation, time consuming and costly. It does not always seal the seam and depends on proper supervision and human error. If two nonwoven textiles are used this particular problem is increased. It is very difficult for the labour force to apply the seam sealing bentonite on steep slopes.

A sewn liner which is the only other mechanically bonded clay liner in use, is disclosed in EP0490529. It consists of a glue bonded material with lines of stitching through the material in the machine direction to give a nigher friction angle. The stitches are lock stitches requiring one thread on too through the needle which then passes the thread through the liner, while a second thread on the bottom of the liner, supplied by a separate spool, locks the top thread. The machinery to do this sewing is very expensive and the sewing can only be done in a straight line as it is impractical to form a pattern or deviate from the straight line (too slow) and cannot be carried out with this machinery. Furthermore, this type of liner is subject to some problems manifest in the needleounched liner. The glue bonded liner which is then sewn to cope with a steep slope situation, is initially bonded with a water soluble glue to bond the fabrics of the liner and also the clay particles together. The glue used in this process when dry becomes very brittle and the process of sewing the two fabrics together tends to break up the dried glue and cause the bentonite granules to become loose. The bentonite is then free to move within the confines of the linear sewing of the liner. This sewing is only in the machine direction and runs parallel the full length of the liner, the lines of sewing being some 100 mm apart. The loose bentonite material can migrate a considerable distance in the machine direction again causing areas of limited bentonite and a potential failure of the liner. The soluble adhesive, being brittle when dry, can also cause this problem during the handling of the sewn clay liner, when the liner is being loaded, unloaded and during installation on steep slopes where the dry loose bentonite will move down the slome in the machine direction between the lines of stitching which run in the same machine direction vertically up and down she slope.

The parallel stitching in the machine direction at 100 mm apart is the only practical way in which this type of mechanical bonding can be carried out. Although the distance between the rows of stitches can be varied, the stitches themselves can only run in a straight line in the direction of production; this means that this problem is actually without a satisfactory solution.

The same problem applies to the sewn liner when the bentonite is hydrated, as with the needlepunched liner, if any machinery or pedestrian traffic or cover material is placed on the liner. In its hydrated form the bentonite will be free to move in the liner within the lines of stitching causing an area of potential leakage where the bentonite is displaced. A lesser problem is the weight of the cover soil or other material which, pulling down the slope, will tend to increase the tensile forces on the cross weave of the top fabric of the clay liner which is the weaker weave of the liner. This is due to the stitching being in line with the forces down the slope and not being staggered or offset to distribute the load or force acting in the machine direction.

EP-0611850 discloses a further type of geosynthetic clay liner including a layer of bentonite disposed between a carrier sheet and a cover sheet which are linked to one another via a plurality of tufting threads formed by a conventional tufting machine. A bight or loop portion of the tufting thread extends through to the undersurface of the carrier sheet and is partially melted to prevent the bight portion from slipping back through the carrier sheet. Due to the large number of tufting threads crossing the bentonite layer there is no need for gluing the bentonite to the inner side of the carrier sheet and the cover sheet. The partially melted bight portions create an undersurface with a high coefficient of friction thereby improving the liner stability on steep slopes. However, the liner according to this disclosure is provided with fastenings arranged on parallel or staggered lines only and has an open pattern of the fastenings which causes the bentonite to be displaced under heavy stresses or by gravity when the clay is either dry or hydrated.

Furthermore, in this liner the presence of a plurality of tufts (i.e. about 15 tufts or loops per inch as usual in tufting machines) not only increase the permeability of the liner, but also weakens the fabric, thereby the liner is unable to withstand multidirectional high shear stress. The production process of this type of geosynthetic clay liner is also complicated by the fact that the liner must be sewn in correspondence to its edges before being passed through the tufting machine.

Bentonite liners are used on the steep slopes of landfills to protect the environment by forming an impermeable barrier on the slope. The steep slopes enable the landfill to be used more efficiently so that the landfill will have a larger containment volume. This is also true of other installations such as tank farms which have steep slopes on the secondary containment areas in case of the tanks rupturing. The bentonite liners therefore need to have higher shear strength, and the bentonite to be so confined that the forces acting down the slope will not cause the liner to fail mechanically or the bentonite to become unstable when used on these slopes.

It is an object of the present invention to provide a flexible clay liner to form a impermeable barrier having a higher stability of the clay layer and higher shear strength with respect to the prior art clay liners, as well as stability on steep slopes and in standing water or inclement weather conditions.

It is another object of the present invention to provide a method for mechanically bonding a geosynthetic clay liner of the above mentioned type which allows the formation of independent fastening means for connecting the fabrics containing the clay liner arranged according to a closed pattern to confine the clay particles.

It is a further object of the present invention to provide a method for mechanically bonding a geosynthetic clay liner of the above mentioned type providing a liner with a surface coarseness adjustable on one or both liner sides according to the needs.

Still another object of the present invention is to provide a machine for mechanically bonding a geosynthetic clay liner of the above mentioned type operating according to the method of the invention.

The above objects are accomplished with the clay liner according to the invention consisting of two woven geotextiles both of high tensile strength in the machine and cross directions, a semihydrated layer or powdered or granular swellable clay between said geotextiles and fastening means connecting the two geotextiles and arranged in such a pattern of connecting threads to form pockets through the clay liner. The fastening means comprises rows of independent fasteners arranged according two intersecting directions, forming an angle with the longitudinal axis of the liner. Each fastener comprises at least a pair of sections of thread passing through the clay liner and the geotextiles and protruding therefrom to form a small loop on at least the underside of the liner said loop being fixed and sealed to the geotextile surface or, preferably, melted into it to form a knot at each fastening site.

The method of the invention comprises the steps of:

preparing a geosynthetic clay liner, comprising two woven geotextiles both of high tensile strength in the machine and cross directions and a semihydrated layer of powdered or granular swellable clay between said geotextiles, according to known methods;

forming on the geosynthetic clay liner symmetrically alternated longitudinal seams having a substantially zigzag path, each seam meeting the adjacent one at least in correspondence of their edges or crests and being formed by threads passing through the liner in correspondance of each fastening site to form a closed pattern.

forming a protruding loop of thread at each fastening site on at least one side of the liner;

locking the so formed loops to prevent them from unthreading.

As a preferred embodiment of the method of the invention, loops are formed on both sides of the liner and are then melted into the geotextiles to form protruding knots on the independent fasteners.

The machine For introducing a geosynthetic clay liner according to the invention and operating according to the above described method comprises a fixed machine frame, means for moving the liner along a feeding direction, a pair of parallel needle bars each carrying at least a row of needles and arranged crosswise with respect to the feeding direction and axially reciprocating in opposite direction with respect to each other, said needle bars further being reciprocated in a direction perpendicular to the plane along which the liner is moved through the machine so as to form corresponding seams extending in the feeding direction with a substantially zigzag path. The machine further comprises a looper bar parallel to the pair of needle bars and placed on the opposite side to them with respect to the liner, from the looper bar there extending radially looper plates in a side-by-side spaced relationship, the looper bar having a rocking movement to engage each looper plate with the thread when the needle has gone to the end of its downstroke thus forming the loop. Means are provided for locking the loop and sealing the passage hole for the thread through the geotextile and means for moving in synchronism said needle bars and said looper arm.

In a preferred embodiment of the machine the means for locking the loops and sealing the corresponding passage holes comprises singeing means for melting the loops and forming protruding knots therefrom. In a further preferred embodiment a needle plate with a plurality of side-by-side spaced apart fingers is provided in a parallel position with respect to the needle bars and from the same side of them with respect to the liner. The needle plate is reciorocated axially in synchronism with the needle bars so that each finger is alternatively placed at one side and at the other side of a corresponding needle while the latter is at the end of its upstroke. In this way at each fastening site loops can also be formed on the other side of the liner.

BRIEF DESCRIPTION OF THE DRAWINGS

The above and other features and advantages of the clay liner according to the invention will become apparent from the following detailed description, given as a non limiting example, taken in conjunction with the attached drawings in which.

BEST MODE OF CARRYING OUT THE INVENTION

Figure 1:
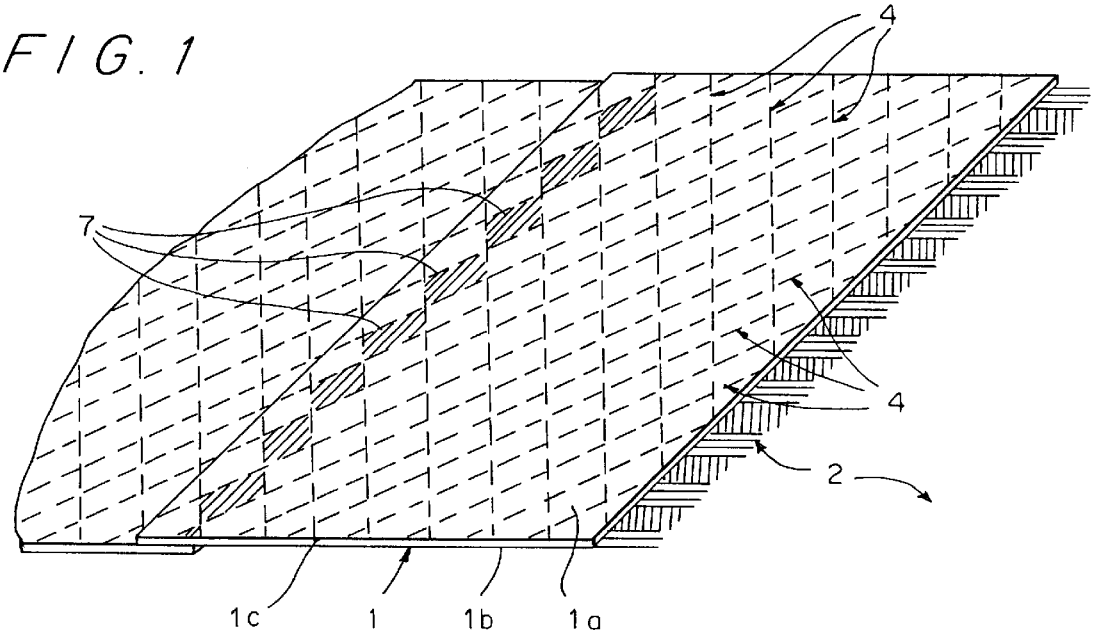
FIG. 1 is a perspective view of a slope to which the liner according to the invention has been applied.

With reference to FIG. 1, there is shown a geosynthetic clay liner 1 according to the invention on a prepared subgrade 2 of a slope of the type used in both landfill and tank farm applications. The liner is usually 4 metres wide by approximately 25 metres long, however this can be varied to requirement. The liner when in use would be locked into an anchor trench, not shown, at the top of the slope in the same way as any other liner used in this field. The sealing at the seams or edges of the liners would be by a simple overlap. The overlap is usually about 15 cm with the adjacent liner.

The liner is comprised of an upper geotextile 1*a*, a lower geotextile 1*b* and a layer 1*c* of water swellable. clay. Geotextiles 1*a* and 1*b* are preferably made of a woven, non-biodegradable polypropylene both of high tensile strength in the machine and cross direction. The water swellable clay is powder or, preferably, granular sodium bentonite, as usual.

Preferably the swellable clay is sprayed and/or mixed with water or liquid polymers to form a semihydrated clay mix with a moisture content in the range of 15–20%. With the clay layer in the semihydrated form the liner is better processed in the fastening machine, as described later, because this machine as any other, is subject to considerable vibration during operation and this would substantially displace any loose or powdered clay and cause variation in weight per unit area. Furthermore, the semi-hydrated mix is easier to keep in position than dry material prior to fastening and dusty conditions are avoided during manufacturing and installation. The liquid polymer mix contains other usual chemicals and additives to enhance the physical properties of the clay and to give the liner 1 its high degree of flexbility. This enables the liner 1 to be fitted to complex shapes and areas without the granules becoming loose. A typical chemical that can be added in this way is a trisodiumpyrophosphate compound or similar products to protect the clay from bivalent cations. A polymer mix that can be used with advantage is disclosed in the International Application no. PCT/IT94/00041 in the name of the same Applicant.

Figure 5:
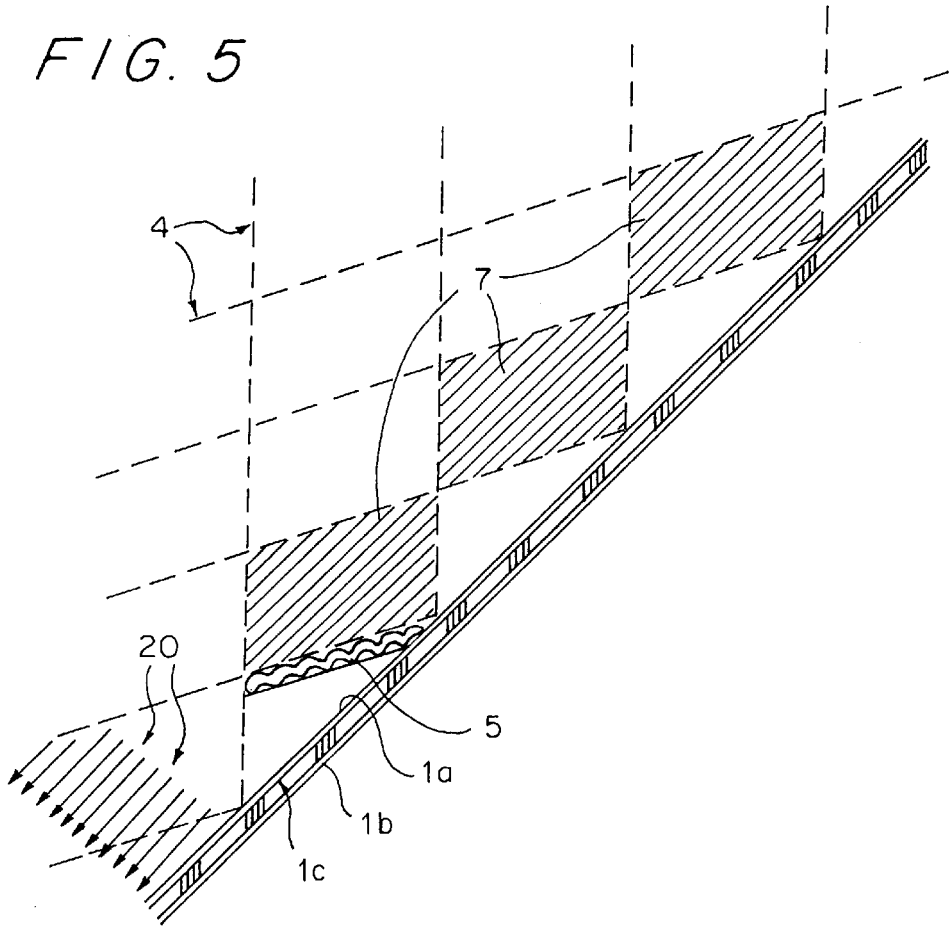
FIG. 5 shows the spread of the tensile forces across the pattern of the fastenings in a clay liner according to the invention.

The upper and lower geotextiles 1*a* and 1*b* are connected by fastening means which in the present embodiment of the invention are formed by mutually intersecting rows 4 of fasteners 5 arranged according two directions forming equal angles with the longitudinal axis of the liner, thus forming a diamond shaped pattern as shown in FIG. 1. The fastening means can be arranged in various other closed patterns and the rows of fasteners can be at various distances to give a variation in the size of pattern. Other possible patterns could be square, zigzag or curved patterns, or many other shapes that might be preferred, to spread the downward shear forces 20 on the clay liner 1 as shown in FIG. 5. In the case of sewn liners, such as stitched clay liners, on the contrary, the shear forces are concentrated along the stitching lines down the slope thus increasing the risk of breakage of the thread.

Figure 2:
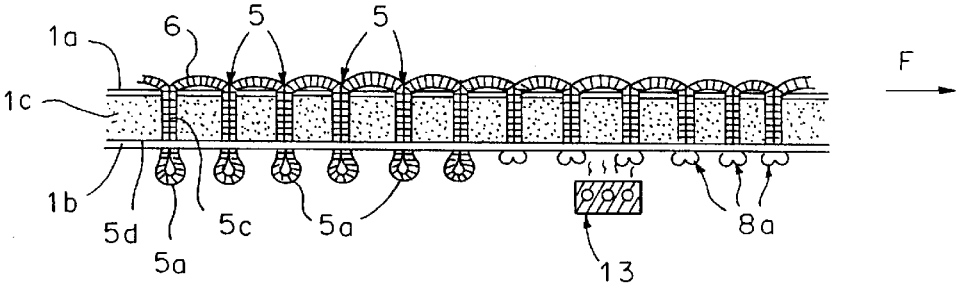
FIG. 2 is a cross sectional view of a first embodiment of the liner according to the invention wherein some fastener loops have been melted.
Figure 3:
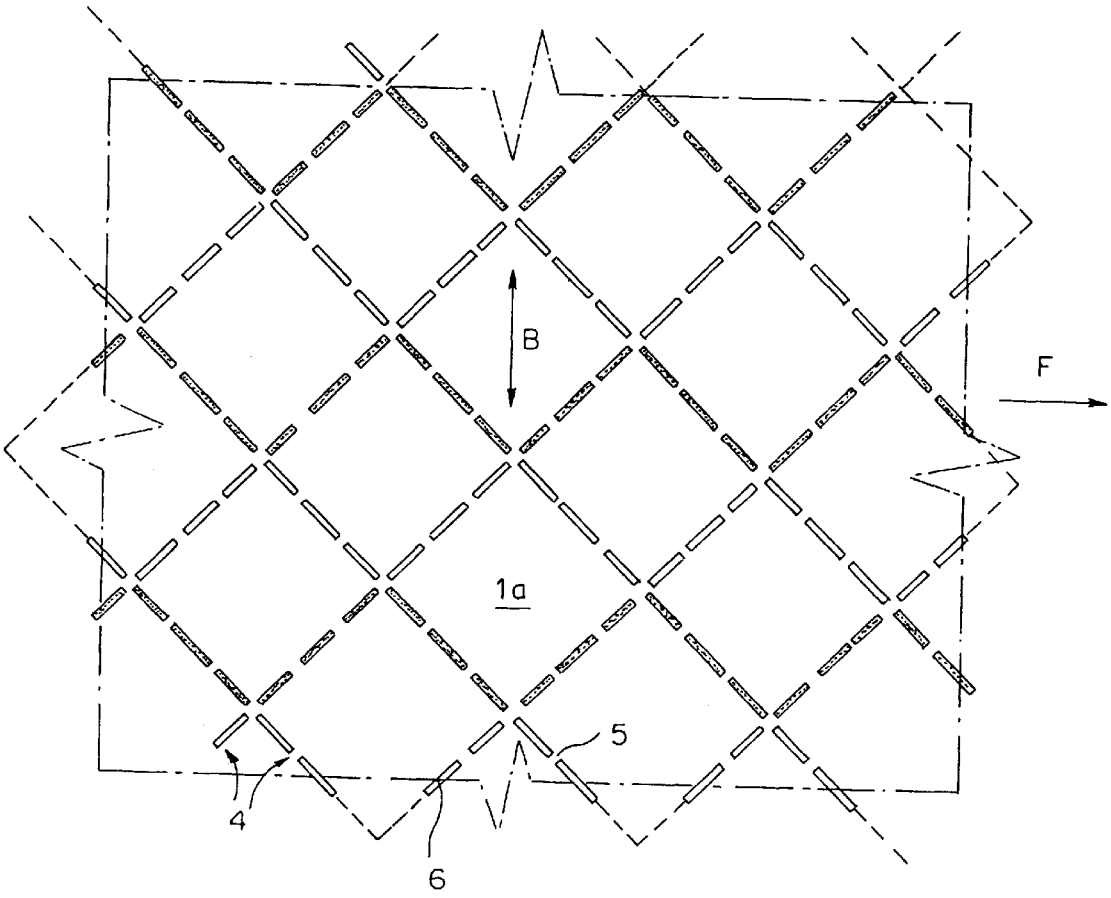
FIG. 3 shows diagrammatically the closed pattern of the threads on the upper fabric of the liner of the invention.

According to one possible embodiment of the invention shown in FIGS. 2 and 3, each row 4 of fasteners 5 is formed by aligned lengths of threads a extending on the upper geotextile 1*a* according to intersecting directions and passing through the clay layer 1*c* to form small loops 5*a* extending from the lower geotextile 1*b*. Each fastener 5 is therefore formed by the two portions 5*c* and 5*d* of thread 6 passing through the clay layer 1*c* connected by a length of thread 6 to the adjacent fasteners on the upper geotextile 1*a* and forming the loop 5*a* on the lower geotextile 1*b*. The loops can be sprayed with a plastic and flexible coating, such as PVC, polyuretane or equivalent, to secure them to the geotextile or, as a particularly advantageous alternative, to make each fastener 5 independent form the adjacent ones, the loops 5*a* can be melted into the geotextiles to form corresponding melted knots 8 on the lower geotextile 1*b* thus preventing any unthreading of fasteners 5.

The clay layer 1*c* is thus mechanically confined into independent pockets 7 of clay, shown with dashed lines in FIG. 1, formed by portions of intersecting rows 4 of fasteners 5. This substantially increases the friction angle through the clay layer 1*c* and increases the tensile strength of the whole clay liner 1.

Figure 6:
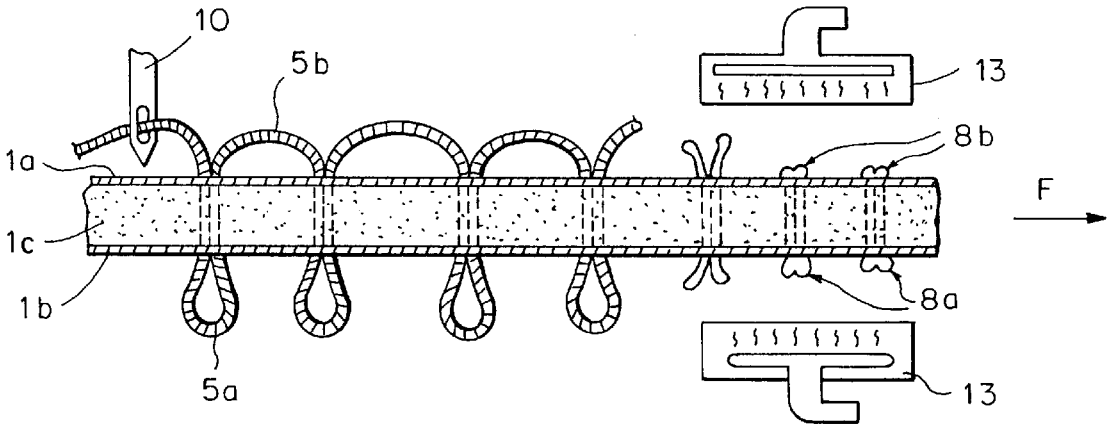
FIG. 6 is a cross sectionaly view of another embodiment of the liner according to the invention showing loops formed on both sides of the liner and singeing units to form individual fasteners with knots on both sides of the liner.

In another, Presently preferred alternative shown in FIG. 6, loops 5*a* and 5*b* are Wormed on both sides of the liner, on the upper and lower geotextile 1*a* and 1*b*, the loops 5*b* being formed by the lengths of threads 6. Each fastener is then constituted by a pair or short sections of thread with their ends being melted into the fabric on each surface of the liner forming a plurality of fastener heads or knots 8 evenly distributed on both surfaces of the liner. The number of fasteners per unit length can be varied by varying the number of needles; a particularly advantageous number is three fasteners per in (2,5 cm. approx.).

The thread is a yarn of similar tensile strength to the geotextile of a polymer, single or multifilament, that will not transmit liquid of any kind. For this purpose it can also be used with advantage a thread manufactured by a technique known in the art as "fibrilation", this process resulting in a net or grid configuration where no one fibre making up the thread is continuous, which limits wicking of liquids along the thread. The material from which fasteners 5 are made can be changed to any suitable material such as nylon, polypropilene, fiberglass, or other form of material to suit the economics or the requirements of the project under construction.

A clay liner according to the invention with a mechanical bonding between the upper and lower fabric forming a pattern of closed pockets to confine the clay particles can be produced in the following way.

Figure 4:
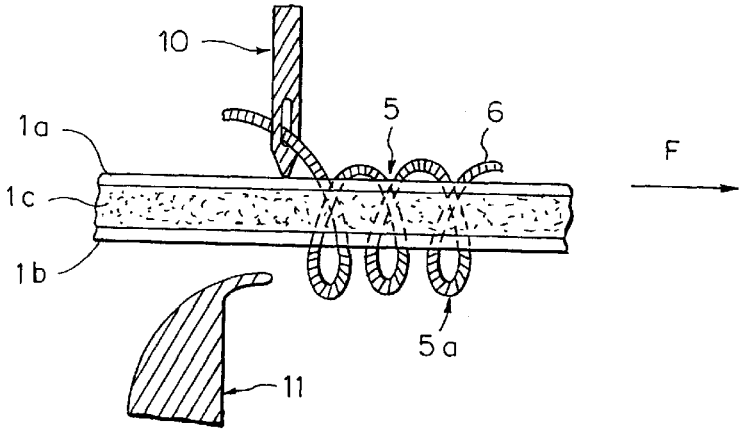
FIG. 4 shows schematically how the fasteners of the liner of FIG. 2 are made.

After forming a semihydrated clay layer 1*c* between two geotextiles 1*a* and 1*b* according to known techniques (for instance, see PCT/IT94/00041), a plurality of threads are passed through the so formed liner so as to form a substantially zigzag path extending lengthwise on the liner, in which two adjacent threads meet one another in correspondance to the angles of the zigzag path thus forming a closed diamond pattern. The fasteners 5 are placed in position by a needle 10 and at least a looper 11, as shown in FIG. 4. Needle 10 holding the thread goes down through the geotextiles 1*a* and 1*b* and the clay layer 1*c* and, as it rises from its lower position, the thread is caught by looper 11 below the lower geotextile 1*b*. When needle 10 moves upwards out of the liner, looper 11 holds the thread to form loos 5*a*. As needle 10 comes down for the second time, the looper 11 moves backwards and the thread loop is released. At the same time, the liner moves forward, helping to clear the loop from looper 11. The needle 10 descends to its lowest position, a new loop is now made and the cycle starts again.

In the case melting of the loops 5*a* is desired, the clay liner can be passed over a heater 13 which will cause the loop thread to melt into geotextile 1*b* fornming the independent fasteners 5 between geotextiles 1*a* and 1*b*. The heater can be either of the gas for electric type or an infrared neater, or equivalent.

In the case of a liner with loops 5*a* and 5*b* on both sides a further looper, not shown, is used for forming the loops on upper geotextile. In this case the loops on the upper geotextile are formed by the lengths of threads 6 which are passed over the loopers by the travelling needles. If the loops on both sides have to be melted into knots 8, two heating units 13 must be used.

The individual fasteners formed with the above described method form a closed pattern on the liner thus locking the clay between the fabrics into the pockets of this pattern so that the clay cannot escape from the liner whether in dry form or hydrated. These fasteners between the two fabrics also set up a high shear strength making the liner very stable on steep slopes with a high internal friction angle.

The protrusion of the loops 5*a*, 5*b* and of the melted loops on the surfaces of the liner 1 gives these surfaces a very rough finish. These protrusions or the rough finish will lock into the material above and below the liner 1 and give a high interface friction angle at the surface contact further improving the slope stability on steep inclines. This would be with the subgrade 2 below the liner 1 or the cover soil above, or the protrusions would lock into any textured fabric or membrane in contact with the liner. The heads of the fasteners lock into the soil (or fabric) above and below the liner. The force of the top soil (or fabric) acts against the head of the fastener in the direction or the force down the slope leaving a passive area behind the head of the fastener, thus reducing any force on the top textile of the liner. The same thing happens on the bottom fastener head, only in the reverse direction. This means that the main shear forces are carried by the high tensile strength fasteners and any forces on the upper and lower textiles of the liner are greatly reduced. This gives better performance of the liner on steep slopes, and as the fasteners are individual, this makes the liner more reliable. This further provides the required tensile strength to prevent slippage of the soil cover and prevent creep failure or damage to the fabrics and various geosynthetic components. The coarseness of either surface can be increased or reduced as required by the customer or as recommended by the design Engineer to suit the project design by adjusting the size of the loops on the top or bottom surfaces of the liner to increase or decrease the length so the loop and then the size of the melted knot. This is obtained by adjusting the distance of loopers from the liner travelling plane.

The melting of the loops or ends of the fasteners therefore provides three main functions. First of all it forms the independent and individual fasteners (which are unconnected, as seen in FIG. 6) joining the two fabrics of the liner through the clay layer to give the high internal shear strength. Secondly, it seals the ends of the fasteners to preserve the low permeability of the liner, and thirdly, it creates a textured or rough surface interface friction when installed on a steep slope. Another important function is that the forces acting on the liner system are mainly taken up by the individual fasteners, rather than being taken up by the textiles as in all other types of liners in use.

The geosynthetic clay liner 1 is manufactured on a continuous basis and cut to the required length. The finished product is rolled onto a central core to produce a roll of aporoximately 45 cm diameter. The rolled up liner can be then rolled out down the steep slope of a landfill or containment area to obtain more efficient use of the ground area in the application and protect the environment. This also applies to the steep slopes of tank farm bund walls and for pond liners. It can also be rolled out directly onto a flat roof area to prevent leakage when used in conjunction with other roofing materials. The liner with upper and lower loops or knots can be installed with either surfaces being uppermost. The liner therefore can be installed using machinery to unroll and place the liner or can be installed by hand labour either on steep slopes or flat installations at reduced costs of installation.

Figure 7:
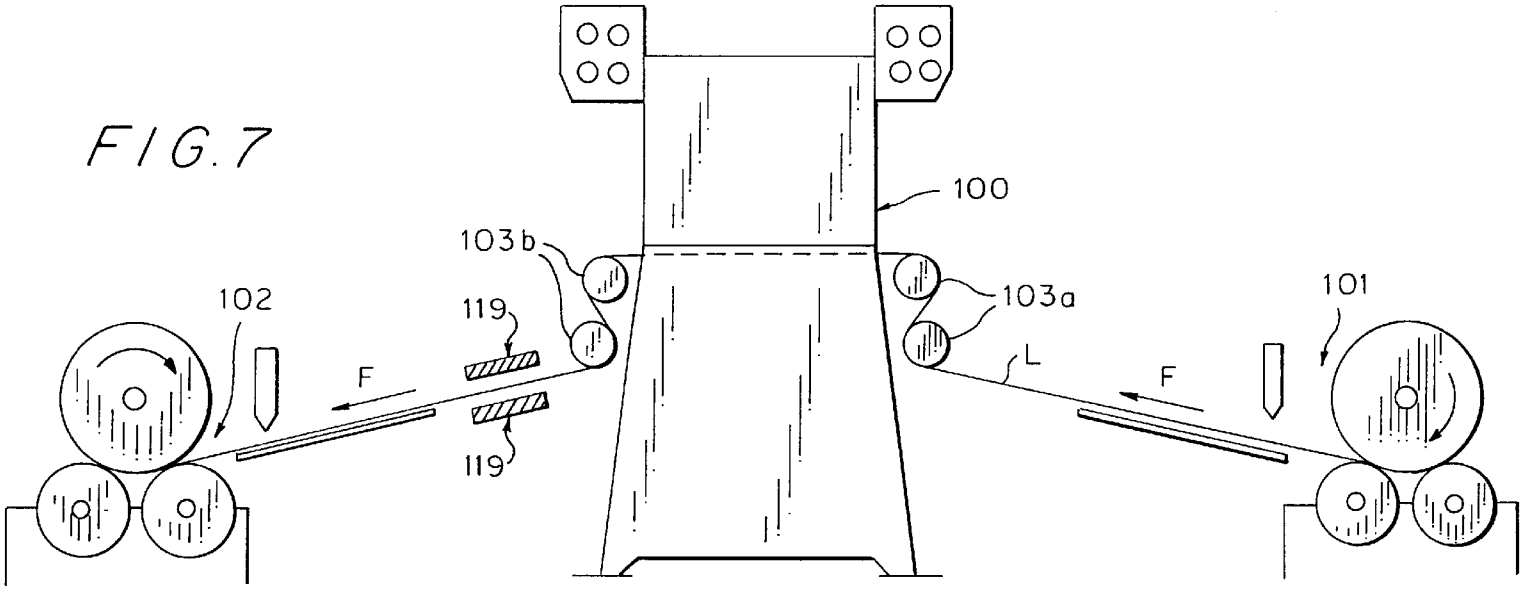
FIG. 7 is a schematic side elevational view of the machine for producing the liner of the invention.
Figure 8:
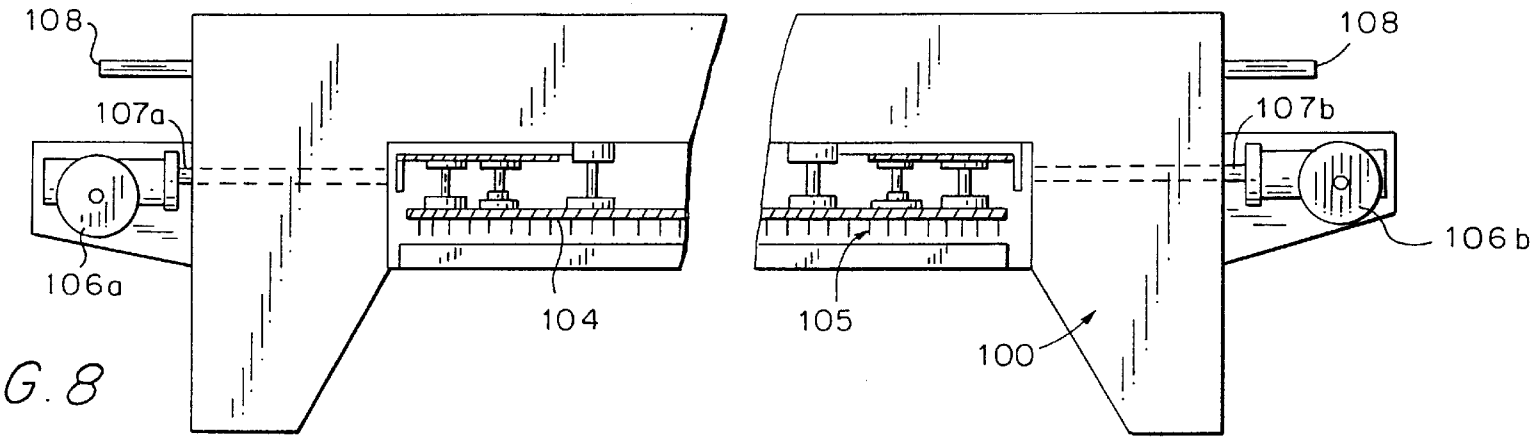
FIG. 8 is a front view of the machine of FIG. 7.
Figure 9:
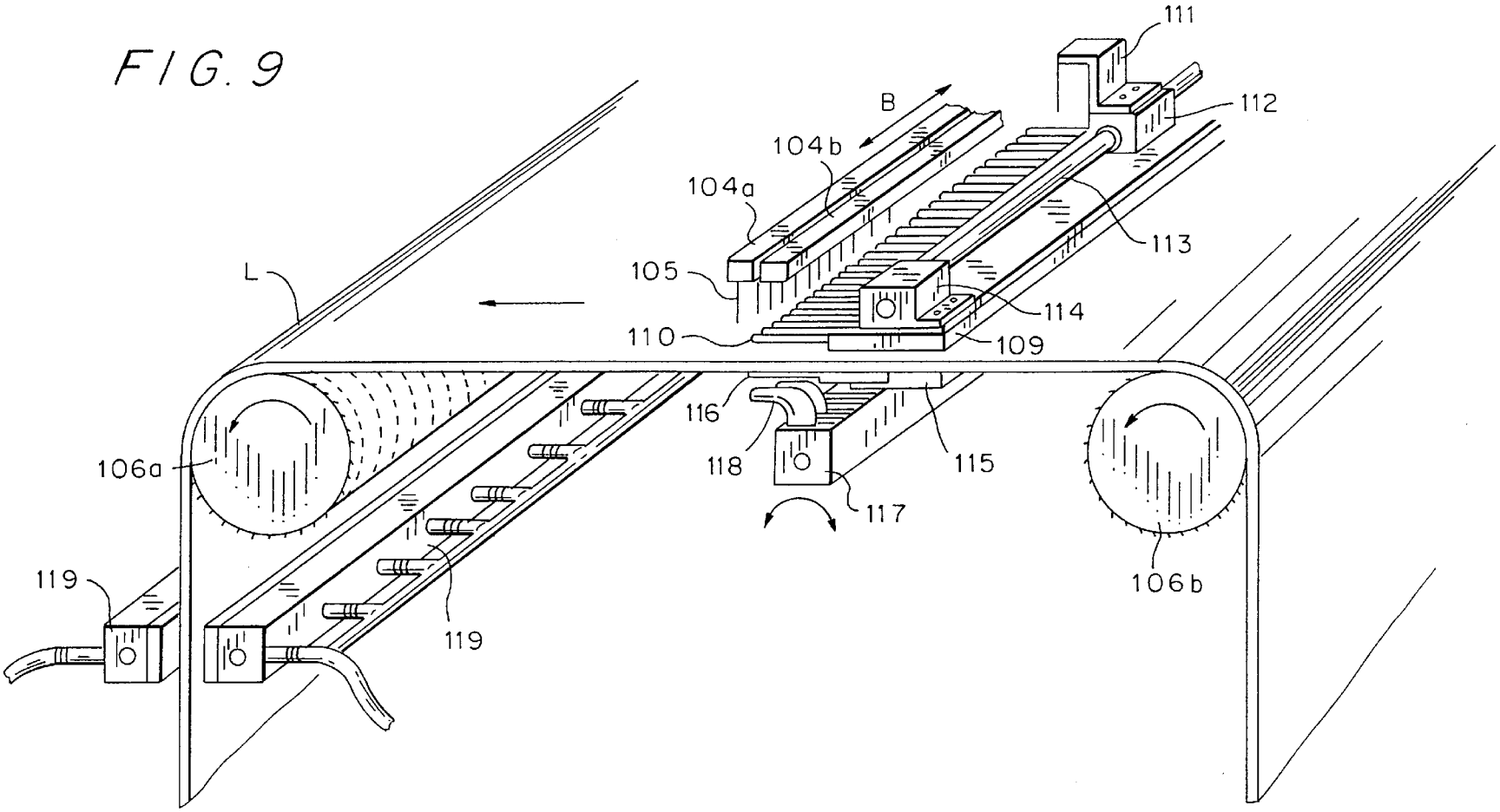
FIG. 9 is a schematic perspective view of the machine of FIG. 7.
Figure 10:
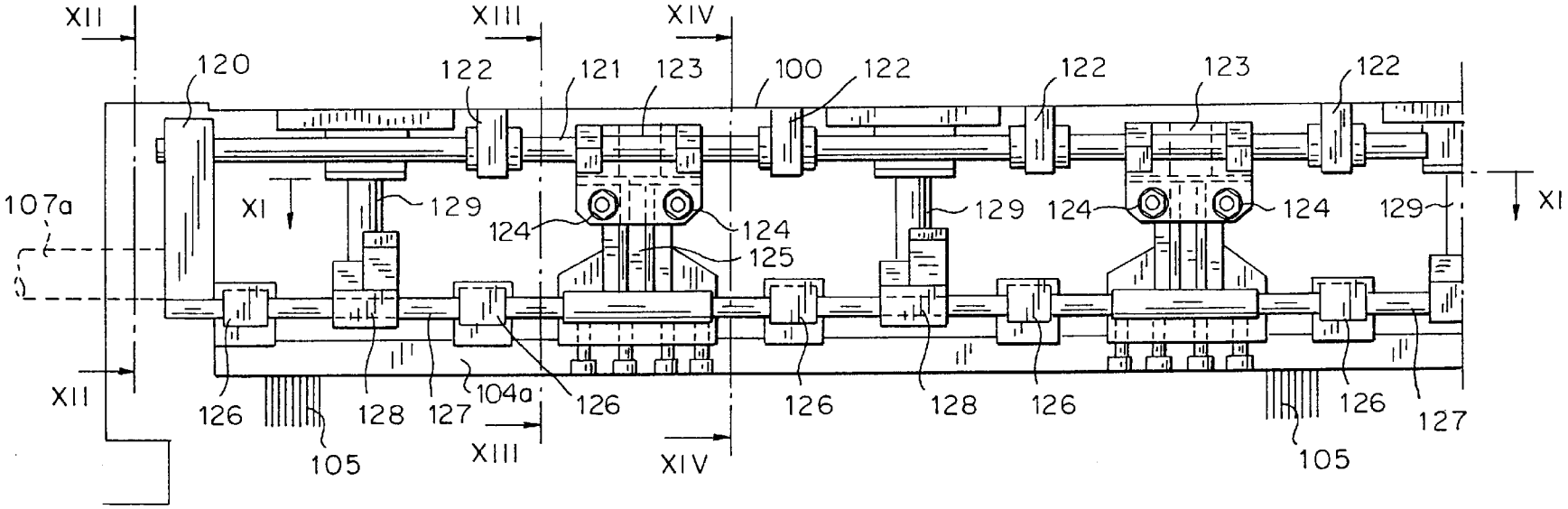
FIG. 10 is a partial side elevational view of the mechanical arrangement for driving the needle bars in the machine of FIG. 7.
Figure 11:
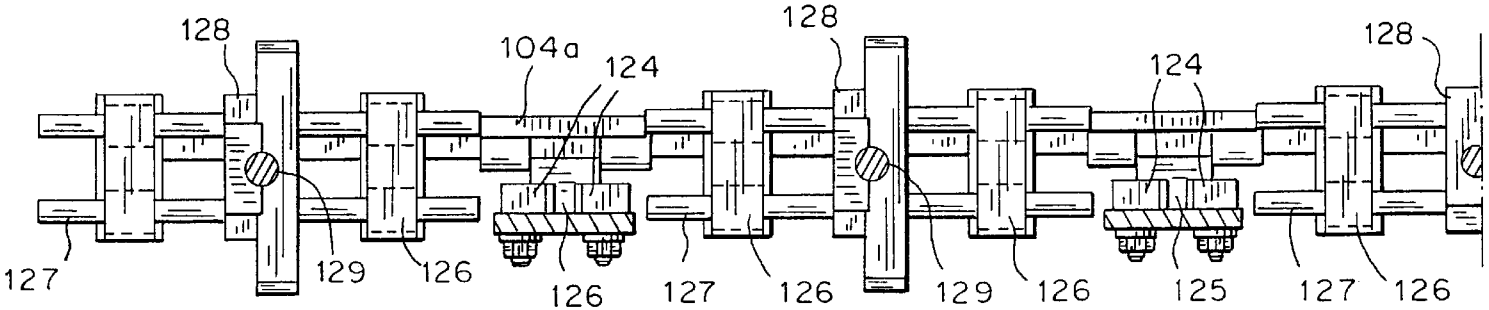
FIG. 11 is a top sectional view of the arrangement of FIG. 10 taken along line XI—XI of FIG. 10.
Figure 12:
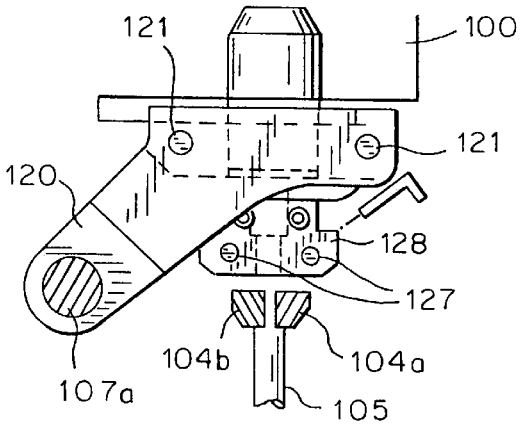
FIG. 12 is a side sectional view taken along line XII—XII of FIG. 10.
Figure 13:
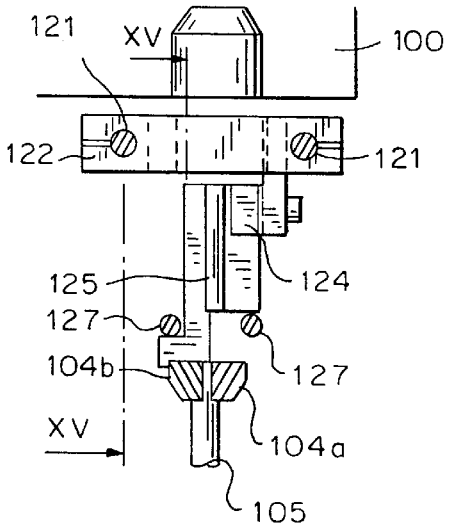
FIG. 13 is a side sectional view taken along line XIII—XIII of FIG. 10.
Figure 14:
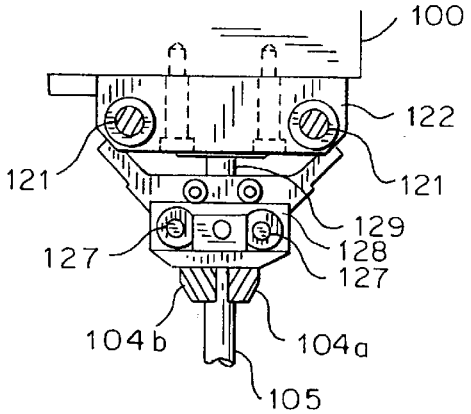
FIG. 14 is a side sectional view taken along line XIV—XIV of FIG. 10, but with needle bars at their top dead centre.
Figure 15:
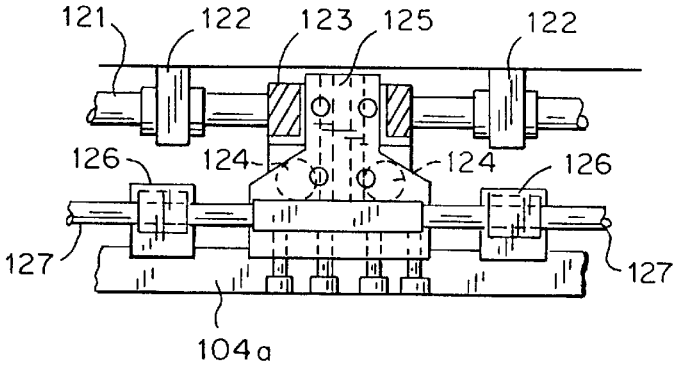
FIG. 15 is a side sectional view taken along line XV—XV of FIG. 13, but with needle bars at their top dead centre.

With reference to FIGS. 7, 8 and 9, the machine of the invention comprises a bridge-like frame 100 through which the geosynthetic clay liner L is massed continuously along a feed direction F. The liner to be processed can be supplied from a roll out unit 101 at the inlet side of the machine and wound again in a roll up unit 102 at the outlet side thereof after processing. The liner is fed into and out of the machine by inlet and outlet pin rolls 103*a,b* which keep the liner in the correct position while passing through the machine.

Two parallel needle bars 104*a,b* are supported by frame 100 transversally to the liner feed direction. Each needle bar 104*a,b* holds a row of needles 105 and moves from side to side in opposite directions to one another indicated as 3 in FIG. 9, as well as up and down. The sideways movement of the needle bars 104*a,b* is brought about by respective cams 106*a*,106*b* located at the ends of the machine, driven through a gear box, not shown, from a main drive shaft 108, and connected to the needle bars by reciprocating shafts 107*a,b* as described in more detail below. The profiles of cams 106*a*,106*b* operate reciprocating shafts 107*a,b* through cam followers, not shown, and control the sideways movement. The machine frame 100 also supports a needle plate 109 extending parallel to needle cars 104*a,b* and at the same side over the running liner. A plurality of parallel fingers 110 extends from one longitudinal edge of needle plate 109 towards the rows of needles 105. Needle plate 109 is supported by the machine frame by a number of brackets 111 extending from the upper part of frame 100 and holding guide bearings 112 into which is slidably mounted a shaft 113 connected to the needle plate by blocks 114 fixed to needle plate 109. The needle plate 109 is also operated by a cam (not shown) at one side of the machine in the same way as needle bars 104*a,b* so that needle plate 109 can perform an alternating sideways movement serving both needle bars. The needle plate cam is operated by a cam driver through a gear reducer and timing belt (all not shown) from main shaft 108.

A lower needle plate 115 situated on the underside of the liner supports the liner during the process and has spaced fingers 116 to allow the passage or needles 105.

At the underside of liner L in correspondance to needle plate 109 a looper bar 117 is provided which extend crosswise to the liner travel direction. Looper bar 117 carries radially a plurality of spaced looper plates 118 in the form of substantially angled fingers extending below needle plate fingers 110 and lower needle plate fingers 116. Looper bar 117 is operated by a crankshaft, not shown, driven from main drive shaft 108 by a timing belt, not shown. The crankshaft operating looper bar 117 causes looper plates 118 to oscillate to perform a rocking motion as shown in FIG. 9.

Downstream the outlet pin rollers 103 a singeing unit 119 of the conventional type (for example a PAREX unit) is provided and formed, in the present embodiment of the invention, by two gas fired units located at both sides of the liner.

As shown in FIGS. 10 to 15, where for sake of clarity only a portion of one needle bar (104*a*) is shown, reciprocating shaft 107*a* has a radial arm 120 at one end carrying a pair of supporting shafts 121 held to frame 100 of the machine by a number of spaced guider bearings 122 in which they are slidably mounted for reciprocating motion. Supporting shafts 121 extend from one end of the machine for a length substantially lower than that of the corresponding needle bar 104*a*. Two roller brackets 123 are clamped to supporting shafts 121 in a spaced relationship and each carries a pair of spaced guide rollers 124 for sliding on a vertical guide member 125 placed therebetween fixed to needle bar 104*a* and vertically extending from it. Needle bar 104*a* is also provided with a number of linear bearings 126 along its length, each pair of them slidably supporting a pair of short guide rods 127 at the centre of which a bracket 128 is clammed for holding a mush rod 129 transmitting an up-and-down movement to needle bar 104*a* supplied by main drive shaft 108.

It is clear from the foregoing that reciprocating shafts 107*a,b* through respective radial arms 120 operate supporting shafts 121 causing them to move horizontally across the direction of travel of liner L for small distances governed by the cam profile. This action is transmitted through guide rollers 124 to vertical guide members 125 which are fixed to needle bar 104*a* causing it to move the required distance, One needle bar is operated by a cam at one side of the machine and the other needle bar is operated by a similar cam at the other side.

The up-and-down movement is transmitted to needle bar 104*a* through push rods 129, which are fixed to machine frame 100, and guide rods 127, which slide into bearings brackets 126 integral to needle bar 104*a*. Bearing brackets 126 move needles bar 104*a* up and down while at the same time allowing it to move from side to side as dictated by cam 106*a* through supporting shafts 121, guide rollers 124 and vertically moving guide members 125.

The second needle bar 104*b* is controlled in the same way by cam 106*b*, reciprocating shaft 107*b* and other members as needle bar 104*a* at the other side of the machine which has exactly the same structure as that shown in FIGS. 10 to 15 and described above for needle bar 104*a*.

In operation, the fabric of the geosynthetic clay liner L masses over the inlet pin rolls 103*a* which hold the liner in position and in tension while the two outer fabrics are fastened together. Liner L passes under needle bars 104*a,b* to have the thread which will form the individual fasteners passed through the liner by needles 105 to create a closed pattern of the thread connectors or fasteners. One needle bar forms one half of the pattern and the other needle bar forms the other half of the pattern due to the movement in opposite directions of the two needle bars.

At each passage of needles 105 loops are formed on the upper and lower surface of liner L. Loops on the upper liner surface are formed by sliding needle plate 109 which moves in a sideways movement back and forth. As needle bars 104*a,b* reach the top dead centre, the needle plate cam is timed so that the needle plate 109 moves fingers 110, laying next to needles 105, to the other side of needles 105 so that, when needles 105 make their downward stroke, they are at the other side of fingers 110, which causes the thread to be looped over each finger 110. When needle bars 104*a,b* move the needles again to top dead centre the needle plate cam causes the needle plate to move the fingers back to the other side of the needles and so continually forms these loops in the thread. Needle plate 109, therefore, moves one pitch to the right and one pitch to the left to form the loops on any variation of the pattern. When needle bars 104*a,b* are on the bottom dead centre looper plates 118 on the underside of liner L moves forward and pick up the thread to form lower loops. Once formed upper-and lower loops are pulled from fingers 110 and looper plates 118 by the motion of the liner moving forward through the machine. The rocking motion of looper bar 117 also helps release the lower loop of thread. The movements of all these parts are synchronized with the movement of needle bars 104*a,b* and are all operated by main drive shaft 108.

After liner L has passed under needle bars 104*a,b* and the loops have been formed, it passes through outlet pin rollers 103*b* and between two singeing units 119 containing heating elements and being continuous across the full width of the machine and the liner. The heat from these units is set to a required temperature for the type of liner being produced and can be adjusted to suit the temperature needed to melt and seal the yarn fasteners. In particular, the heat is set to melt the loops to the required amount and can be adjusted if the loops are to be longer or shorter (for increasing or reducing the surface friction). The singeing units are electrically connected to the control board of the machine so that the temperature is automatically adjusted to the speed of the liner through the machine. The singeing units will also automatically shield the liner from overheating if the machine is stopped. Under normal operation the loops of thread on either side of the liner will melt as they pass between the singeing unit. In doing so the loops are broken and melt into a ball on the surface of the liner forming individual and independent fastenings between the upper and lower fabrics of the liner that are tightened up by the heat and the ends of fastenings become heat sealed on both surfaces of the liner.

In the present embodiment of the invention, the needles 105 in the needle bars 104*a,b* are spaced at 2.5 inches (6,25 cm). The fingers 110 on needle plate 109 are spaced at ⅛ inch (3 mm) across the full width of the machine, the looper plates 118 on the under side of the liner are also spaced at ⅛ inch (3 mm) across the full width of the machine. The fingers of the sliding needle plate 109 and the loopers 118 are used by the needles 105 in-needle bars 104*a,b*. Half of the fingers 109 and loopers 118 are used by needle bar 104*a* and half are used by needle bar 104*b*. The large number of fingers 110 and loopers 118 available improves the flexibility of the operation of the machine by the ability to change the pattern of the fasteners.

The pattern formed on the liner can be varied in size, type and shame by changing the profiles of cams 106*a,b* which control the sideways movement of needle bars 104*a,b*. Though she machine according to the invention has been described as fed by separate rolls of prepared liner, it is obvious that it can be constructed as a part of a production line and fed with a continuous liner.

From the above it can be seen by those experienced in the fields of Civil, Environmental and Geotechnical Engineering that a liner of this type has many engineering and economic advantages in terms of a) reliability, due to the fasteners taking the majority of the shear stresses away from the body and fabrics of the liner while maintaining a high internal friction angle through the clay layer; b) slope stability, due to interlocking of the fasteners into the upper and lower surfaces of the installation in which the liner is being used; c) performances of the liner as an impermeable barrier and due to the increase in strength that can be provided by the variation in size, type, thickness and depth of the fasteners and the textiles used in the manufacture of the liner; and d) cost, adjustable to suit the project and due to the fact that in many cases the use of this liner will dispense with other forms of reinforcement that are necessary with other liners. It has also to be noted that, while in prior art geosynthetic clay liners such as that disclosed in EP-0611850, a plurality of stitches or tufts (15 per 2.5 cm approx.) are required to obtain the required layer stability, with the consequence of a substantial weakening of the liner and increase of permeability, in the liner according to the invention, due to the closed pattern and the pocket structure of the bonding, no more than 3 fasteners are 2.5 cm approximately are requested. The use of bentonite liner in vertical or steep slopes can be made with heavier cover material with the obvious advantages which cannot be achieved by similar liners. This liner can also be used without cover in these conditions and will not be affected by heavy rain or inclement weather. If required the cover material can be applied after hydration of the clay. The liner can be installed in standing water dispensing with the need for drainage if necessary. This enables its use in preventing roof leakage.

We claim:

1. An impermeable liner comprising two synthetic geotextiles (1*a*, 1*b*) with a semihydrated layer (1*c*) of swellable clay between said geotextiles and fastening means (5) connecting the two geotextiles, wherein said fastening means (5) are arranged in such a pattern to form pockets (7) through the clay layer and are arranged in rows of independent unconnected fasteners (5) arranged in two intersecting rows (4) forming an angle with the longitudinal axis of the liner.

2. The liner according to claim 1, wherein each fastener (5) comprises at least a pair of sections of thread (5*c*,5*d*) passing through said clay layer (1*c*) and said geotextiles (1*a*,1*b*) and protruding therefrom to form a small loop (5*a*) on at least one side of the liner.

3. The liner according to claim 2, wherein each fastener (5) further comprises a second loop (5*b*) protruding from the other side thereof.

4. The liner according to claim 3, wherein said loops are secured by a plastic flexible coating sprayed on them.

5. The liner according to claim 1, wherein each fastener (5) comprises at least a pair of sections of thread (5*c*,5*d*) passing through said clay layer (1*c*) and said geotextiles (1*a*,1*b*) and protruding therefrom with a small knot (8*a*) on the underside thereof.

6. The liner according to claim 5, wherein the knot comprises a ball.

7. The liner according to claim 1, wherein said geotextiles (1*a*,1*b*) are of woven high tensile, polypropilene.

8. The liner according to claim 1, wherein said thread is a high tensile, single-or multi-filament yarn.

9. The liner according to claim 1, wherein said loops or said knots protrude from the sides of the liner by a variable extent so that the surface coarseness can be adjusted to the needs for an improved frictional resistance.

10. The liner according to claim 1, wherein said clay layer is sodium bentonite clay mixed with a liquid polymer mix to form a semihydrated clay layer.

11. The liner according to claim 1, wherein a number of fasteners not greater than three per 2.5 cm approx is provided along each row of fasteners.

12. The liner according to claim 1, wherein the connecting threads comprise fibrillated thread.

13. A method of making a geosynthetic clay liner comprising:

disposing a layer of semihydrated swellable clay between a synthetic geotextile first liner and a synthetic geotextile second liner;

disposing a thread through a series of pairs of holes located oppositely in the first liner and in the second liner, such that on the first side a plurality of first loops are formed between adjoining ones of the holes in the first liner, and on the second side a plurality of second loops are formed at respective individual holes in the second liner; and melting the first loops and the second loops;

whereby each of the second loops forms a respective ball and each of the first loops forms a pair of balls, the pair of balls being located at the adjoining ones of the first holes.

14. A geosynthetic clay liner made by the process of claim 13.

15. The method according to claim 13, wherein the step of disposing the thread further comprises:

stitching the first and second liners such that the series of pairs of holes located oppositely in the first liner and in the second liner form a first zig-zag pattern; and stitching the first and second liners such that the series of pairs of holes located oppositely in the first liner and in the second liner form a second zig-zag pattern; and positioning the first zig-zag pattern and the second zig-zag pattern to form pockets.

16. A geosynthetic clay liner made by the process of claim 15.

17. An impermeable liner, comprising two synthetic geotextile layers with a semi-hydrated layer of swellable clay between said geotextile layers, and a plurality of thermoplastic threads extending through said geotextile layers and swellable clay therebetween, said thermoplastic threads connecting said geotextile layers together, said thermoplastic threads each having a first end and a second end with enlarged portions of said thermoplastic thread at each of said first and second ends, said thermoplastic threads extending throughout their respective lengths generally perpendicular to said geotextile layers, said enlarged ends of said first and second ends of said thermoplastic threads abutting respectively against exterior surfaces of said geotextile layers, said thermoplastic threads being arranged in rows, a first plurality of said rows extending in one direction and a second plurality of said rows extending in a second direction, said first plurality of rows intersecting said second plurality of rows at an angle with the longitudinal axis of the liner.

18. An impermeable liner comprising two synthetic geotextiles (1*a*, 1*b*) with a semihydrated layer (1*c*) of swellable clay between said geotextiles and fastening means (5) connecting the two geotextiles, characterized in that said fastening means (5) are arranged in such a pattern to form pockets (7) through the clay layer and comprises rows of independent unconnected fasteners (5) arranged in two intersecting directions (4) forming an angle with the longitudinal axis of the liner, wherein each fastener (5) comprises at least a pair of sections of thread (5*c*, 5*d*) passing through said clay layer (1*c*) and said geotextiles (1*a*, 1*b*) and protruding therefrom with a small knot (8*a*) on at least the underside thereof, and further a protruding knot (8*b*) on the other side thereof.

19. The liner according to claim 18, wherein the knot comprises a ball.

* * * * *